US009447937B2

(12) United States Patent
Fournier et al.

(10) Patent No.: US 9,447,937 B2
(45) Date of Patent: Sep. 20, 2016

(54) ELECTRONIC LUMINARY DEVICE WITH SIMULATED FLAME

(71) Applicant: Winvic Sales Inc., Markham (CA)

(72) Inventors: Bernard Fournier, Delson (CA); Michael Toutant, Chateauguay (CA); Jonathan Landry, Montreal (CA)

(73) Assignee: NII Northern International Inc., Vancouver (CA)

( * ) Notice: Subject to any disclaimer, the term of this patent is extended or adjusted under 35 U.S.C. 154(b) by 0 days.

(21) Appl. No.: 14/754,077

(22) Filed: Jun. 29, 2015

(65) Prior Publication Data

US 2015/0300586 A1 Oct. 22, 2015

Related U.S. Application Data

(63) Continuation of application No. 13/789,624, filed on Mar. 7, 2013, now Pat. No. 9,068,706.

(60) Provisional application No. 61/607,942, filed on Mar. 7, 2012.

(51) Int. Cl.
*F21V 33/00* (2006.01)
*F21S 10/04* (2006.01)
(Continued)

(52) U.S. Cl.
CPC ..... *F21S 10/043* (2013.01); *F21L 4/00* (2013.01); *F21L 15/02* (2013.01); *F21S 6/001* (2013.01);
(Continued)

(58) Field of Classification Search
CPC ..... F21S 10/04; F21S 10/043; F21S 6/001; F21S 9/02; F21L 4/00; F21L 15/02; F21L 23/003; F21W 2121/00; F21V 33/0028
USPC ..... 362/234, 292, 810
See application file for complete search history.

(56) References Cited

U.S. PATENT DOCUMENTS 212,401 A 2/1879 Requa
643,493 A 2/1900 Fuller
(Continued)

FOREIGN PATENT DOCUMENTS

CN 2499694 Y 7/2002
CN 2562059 Y 7/2003
(Continued)

OTHER PUBLICATIONS

The State Intellectual Property Office of the People's Republic of China, Notification of the First Office Action, in Application No. 2012800730291, dated Oct. 29, 2015 (11 pages).
(Continued)

*Primary Examiner* — Ali Alavi
(74) *Attorney, Agent, or Firm* — McAndrews, Held & Malloy, Ltd.

(57) ABSTRACT

A flameless candle may include a side wall including an upper region and a lower region, a base engaged with the lower region of the side wall, and an upper surface extending from the upper region of the side wall to form an upper recess. The candle may also include a projection screen extending upwardly through an aperture in the upper surface. The position of the projection screen is fixed with respect to a position of the upper surface. Two sources of light positioned below the upper surface may project light through the aperture onto the projection screen. Circuitry may electrically connect to the first source of light and the second source of light. The circuitry may independently control each of the sources of light.

22 Claims, 4 Drawing Sheets

(51) Int. Cl.

| | |
|---|---|
| ***F21L 4/00*** | (2006.01) |
| ***F21V 1/00*** | (2006.01) |
| ***F21S 6/00*** | (2006.01) |
| ***F21V 23/00*** | (2015.01) |
| ***F21S 9/02*** | (2006.01) |
| *F21W 121/00* | (2006.01) |

(52) U.S. Cl.

CPC ..... *F21S 9/02* (2013.01); *F21S 10/04* (2013.01); *F21V 23/003* (2013.01); *F21V 33/0028* (2013.01); *F21W 2121/00* (2013.01)

(56) References Cited

U.S. PATENT DOCUMENTS

| | | | | |
|---|---|---|---|---|
| 838,075 | A | 12/1906 | Brown | |
| 1,736,820 | A | 11/1929 | Black | |
| 1,824,388 | A | 9/1931 | Birch | |
| 1,893,730 | A | 1/1933 | Charles | |
| 2,131,410 | A | 9/1938 | Newton | |
| 2,278,816 | A | 4/1942 | Zabel | |
| 2,435,811 | A | 2/1948 | Waters | |
| 2,811,711 | A | 10/1957 | Cade | |
| 2,935,041 | A | 5/1960 | Rovere | |
| 2,976,450 | A | 3/1961 | Benoliel | |
| 3,127,539 | A | 3/1964 | Convertine | |
| 3,150,709 | A | 9/1964 | Bolmgren | |
| 3,233,093 | A | 2/1966 | Gerlat | |
| 3,315,497 | A | 4/1967 | MacDonald | |
| 3,384,774 | A | 5/1968 | English | |
| 3,413,458 | A | 11/1968 | Barefoot | |
| 3,435,286 | A | 3/1969 | Kayatt | |
| 3,514,660 | A | 5/1970 | Kopelman | |
| 3,639,749 | A | 2/1972 | Beckman | |
| 3,681,588 | A | 8/1972 | Lee | |
| 3,710,182 | A | 1/1973 | Van Reenen | |
| 3,749,904 | A | 7/1973 | Graff | |
| 3,814,973 | A | 6/1974 | Thouret | |
| 3,890,085 | A | 6/1975 | Andeweg | |
| 3,978,598 | A | 9/1976 | Rose | |
| 4,026,544 | A | 5/1977 | Plambeck | |
| 4,107,763 | A | 8/1978 | Thiel | |
| 4,253,045 | A | 2/1981 | Weber | |
| 4,328,534 | A | 5/1982 | Abe | |
| 4,381,455 | A | 4/1983 | Komori | |
| 4,477,249 | A | 10/1984 | Ruzek | |
| 4,510,556 | A | 4/1985 | Johnson | |
| 4,550,363 | A | 10/1985 | Sandell | |
| 4,551,794 | A | 11/1985 | Sandell | |
| 4,593,232 | A | 6/1986 | McEdwards | |
| 4,617,614 | A | 10/1986 | Lederer | |
| 4,777,571 | A | 10/1988 | Morgan | |
| 4,839,780 | A | 6/1989 | Chuan | |
| 4,866,580 | A | 9/1989 | Blackerby | |
| 4,965,707 | A | 10/1990 | Butterfield | |
| 5,090,892 | A | 2/1992 | Chuang | |
| 5,097,180 | A | 3/1992 | Ignon | |
| 5,381,325 | A | 1/1995 | Messana | |
| 5,503,550 | A | 4/1996 | DePalma | |
| 5,575,274 | A | 11/1996 | DePalma | |
| 5,600,209 | A | 2/1997 | St. Louis | |
| 5,642,580 | A | 7/1997 | Hess | |
| 5,707,282 | A | 1/1998 | Clements | |
| 5,848,886 | A | 12/1998 | Michaud | |
| 5,858,036 | A | 1/1999 | Chandaria | |
| 5,924,784 | A | 7/1999 | Chliwnyj | |
| 6,017,139 | A | 1/2000 | Lederer | |
| 6,047,489 | A | 4/2000 | Hess | |
| 6,050,011 | A | 4/2000 | Hess | |
| 6,053,795 | A | 4/2000 | Whitney | |
| 6,064,064 | A | 5/2000 | Castleman | |
| 6,066,924 | A | 5/2000 | Lederer | |
| RE37,168 | E | 5/2001 | St. Louis | |
| 6,241,362 | B1 | 6/2001 | Morrison | |
| 6,257,755 | B1 | 7/2001 | Sevelle | |
| 6,269,567 | B1 | 8/2001 | MacPherson | |
| 6,302,555 | B1 | 10/2001 | Bristow | |
| 6,312,137 | B1 | 11/2001 | Hsieh | |
| 6,363,636 | B1 | 4/2002 | Hess | |
| 6,385,881 | B1 | 5/2002 | Hess | |
| 6,454,425 | B1 | 9/2002 | Lin | |
| 6,461,011 | B1 | 10/2002 | Harrison | |
| 6,511,219 | B2 | 1/2003 | Sevelle | |
| 6,515,283 | B1 | 2/2003 | Castleman | |
| 6,518,574 | B1 | 2/2003 | Castleman | |
| 6,564,485 | B1 | 5/2003 | Hess | |
| 6,575,613 | B2 | 6/2003 | Brown et al. | |
| 6,615,519 | B2 | 9/2003 | Hess | |
| 6,616,308 | B2 | 9/2003 | Jensen et al. | |
| D486,924 | S | 2/2004 | Skradski | |
| 6,688,752 | B2 | 2/2004 | Moore | |
| 6,712,493 | B2 | 3/2004 | Tell | |
| 6,719,443 | B2 | 4/2004 | Gutstein | |
| 6,757,487 | B2 | 6/2004 | Martin | |
| 6,799,727 | B2 | 10/2004 | Webster | |
| 6,871,221 | B1 | 3/2005 | Styles | |
| 6,914,534 | B2 | 7/2005 | Tanguay | |
| 6,916,110 | B2 | 7/2005 | Batiste | |
| 6,926,423 | B2 | 8/2005 | Bucher | |
| 6,929,380 | B2 | 8/2005 | Logan | |
| 6,944,982 | B2 | 9/2005 | Schroeter | |
| 6,953,401 | B2 | 10/2005 | Starr | |
| 6,955,440 | B2 | 10/2005 | Niskanen | |
| 6,966,665 | B2 | 11/2005 | Limburg | |
| 6,976,063 | B1 | 12/2005 | Dharmarajan | |
| 7,011,426 | B2 | 3/2006 | Gabor | |
| 7,029,146 | B2 | 4/2006 | Kitchen | |
| 7,030,748 | B2 | 4/2006 | Tanguay | |
| 7,066,637 | B2 | 6/2006 | Nozawa | |
| 7,080,472 | B2 | 7/2006 | Schroeter | |
| 7,083,315 | B2 | 8/2006 | Hansler | |
| 7,093,949 | B2 | 8/2006 | Hart | |
| 7,093,961 | B2 | 8/2006 | Bentley | |
| 7,111,421 | B2 | 9/2006 | Corry | |
| 7,125,142 | B2 | 10/2006 | Wainwright | |
| 7,134,229 | B2 | 11/2006 | Hess | |
| 7,159,994 | B2 | 1/2007 | Schnuckle | |
| 7,162,820 | B2 | 1/2007 | Hess | |
| 7,194,830 | B2 | 3/2007 | Hess | |
| 7,201,500 | B2 | 4/2007 | Mishan | |
| 7,210,256 | B2 | 5/2007 | Rosserot | |
| 7,261,455 | B2 * | 8/2007 | Schnuckle | B44C 5/06 362/161 |
| 7,300,179 | B1 | 11/2007 | LaDuke | |
| 7,350,720 | B2 | 4/2008 | Jaworski | |
| 7,360,935 | B2 | 4/2008 | Jensen | |
| 7,373,743 | B1 | 5/2008 | Hess | |
| 7,377,667 | B2 | 5/2008 | Richmond | |
| 7,422,355 | B2 | 9/2008 | Hirata | |
| 7,481,571 | B2 | 1/2009 | Bistritzky | |
| 7,503,668 | B2 | 3/2009 | Porchia | |
| 7,670,035 | B2 | 3/2010 | Tsai | |
| 7,686,471 | B2 | 3/2010 | Reichow | |
| 7,726,860 | B2 | 6/2010 | Harrity | |
| 7,762,897 | B2 | 7/2010 | Starr | |
| 7,832,906 | B2 | 11/2010 | Damman | |
| 7,837,355 | B2 | 11/2010 | Schnuckle | |
| 7,997,772 | B2 | 8/2011 | Avtzon | |
| 8,021,021 | B2 | 9/2011 | Paolini | |
| 8,070,319 | B2 | 12/2011 | Schnuckle | |
| 8,132,936 | B2 | 3/2012 | Patton | |
| 8,234,803 | B2 | 8/2012 | Gallo | |
| 8,550,660 | B2 * | 10/2013 | Patton | F21S 10/04 362/249.02 |
| 2001/0033488 | A1 | 10/2001 | Chliwnyj | |
| 2002/0011570 | A1 | 1/2002 | Castleman | |
| 2002/0023376 | A1 | 2/2002 | Hess | |
| 2002/0080601 | A1 | 6/2002 | Meltzer | |
| 2002/0093834 | A1 | 7/2002 | Yu | |
| 2002/0139021 | A1 | 10/2002 | Hess | |
| 2002/0175215 | A1 | 11/2002 | Webster | |
| 2003/0035291 | A1 | 2/2003 | Jensen | |
| 2003/0041491 | A1 | 3/2003 | Mix | |
| 2003/0046837 | A1 | 3/2003 | Hess | |
| 2003/0053305 | A1 | 3/2003 | Lin | |

(56) References Cited

U.S. PATENT DOCUMENTS

| | | | |
|---|---|---|---|
| 2003/0081420 | A1 | 5/2003 | Jensen |
| 2003/0110671 | A1 | 6/2003 | Hess |
| 2003/0161145 | A1 | 8/2003 | Liu |
| 2003/0198045 | A1 | 10/2003 | Kitchen |
| 2004/0037069 | A1 | 2/2004 | Blackbourn |
| 2004/0060213 | A1 | 4/2004 | Schroeter |
| 2004/0095253 | A1 | 5/2004 | Tanguay |
| 2004/0114351 | A1 | 6/2004 | Stokes |
| 2004/0165374 | A1 | 8/2004 | Robinson |
| 2004/0165383 | A1 | 8/2004 | Hess |
| 2004/0181983 | A1 | 9/2004 | Hess |
| 2004/0240225 | A1 | 12/2004 | Batiste |
| 2004/0246711 | A1 | 12/2004 | Brenchley |
| 2004/0252498 | A1 | 12/2004 | Gutstein |
| 2004/0264169 | A1 | 12/2004 | Limburg |
| 2005/0072031 | A1 | 4/2005 | Hess |
| 2005/0083682 | A1 | 4/2005 | Logan |
| 2005/0086841 | A1 | 4/2005 | Schroeter |
| 2005/0097792 | A1 | 5/2005 | Naden |
| 2005/0097793 | A1 | 5/2005 | Hess |
| 2005/0151663 | A1 | 7/2005 | Tanguay |
| 2005/0169666 | A1 | 8/2005 | Porchia |
| 2005/0196716 | A1 | 9/2005 | Haab |
| 2005/0248952 | A1 | 11/2005 | Yao |
| 2005/0254232 | A1 | 11/2005 | Bentley |
| 2005/0254242 | A1 | 11/2005 | Baker |
| 2005/0285538 | A1 | 12/2005 | Jaworski |
| 2006/0026894 | A1 | 2/2006 | Hess |
| 2006/0034079 | A1 | 2/2006 | Schnuckle |
| 2006/0034100 | A1 | 2/2006 | Schnuckle |
| 2006/0098428 | A1 | 5/2006 | Rosserot |
| 2006/0101681 | A1 | 5/2006 | Hess |
| 2006/0109666 | A1 | 5/2006 | Tsai |
| 2006/0146544 | A1 | 7/2006 | Leung |
| 2006/0188831 | A1 | 8/2006 | Hess |
| 2006/0232958 | A1 | 10/2006 | Chang |
| 2007/0002560 | A1 | 1/2007 | Gutstein |
| 2007/0014107 | A1 | 1/2007 | Mishan |
| 2007/0094903 | A1 | 5/2007 | Hess |
| 2007/0107280 | A1 | 5/2007 | Stinson |
| 2007/0125367 | A1 | 6/2007 | Lim |
| 2007/0127249 | A1 | 6/2007 | Medley |
| 2007/0159422 | A1 | 7/2007 | Blandino |
| 2007/0177393 | A1 | 8/2007 | Hirata |
| 2007/0177394 | A1 | 8/2007 | Vock |
| 2007/0207424 | A1 | 9/2007 | Benson |
| 2007/0224561 | A1 | 9/2007 | Hess |
| 2007/0236947 | A1 | 10/2007 | Jensen |
| 2007/0242259 | A1 | 10/2007 | Kawakami |
| 2008/0004124 | A1 | 1/2008 | O'Neill |
| 2008/0013931 | A1 | 1/2008 | Bourne |
| 2008/0031784 | A1 | 2/2008 | Bistritzky |
| 2008/0037254 | A1 | 2/2008 | O'Neill |
| 2008/0074875 | A1 | 3/2008 | Jensen |
| 2008/0094825 | A1 | 4/2008 | Silver |
| 2008/0112154 | A1 | 5/2008 | Reichow |
| 2008/0117634 | A1 | 5/2008 | Wong |
| 2008/0129226 | A1 | 6/2008 | DeWitt |
| 2008/0130266 | A1 | 6/2008 | DeWitt |
| 2008/0138050 | A1 | 6/2008 | Moreland |
| 2008/0151534 | A1 | 6/2008 | Lin |
| 2008/0151563 | A1 | 6/2008 | Chen |
| 2008/0151571 | A1 | 6/2008 | Chen |
| 2008/0158863 | A1 | 7/2008 | Tsai |
| 2009/0135586 | A1 | 5/2009 | Yang |
| 2009/0310340 | A1 | 12/2009 | Betz |
| 2010/0001662 | A1 | 1/2010 | Nelkin |
| 2010/0073924 | A1 | 3/2010 | Deng |
| 2010/0254155 | A1 | 10/2010 | Capo |
| 2011/0127914 | A1 | 6/2011 | Patton et al. |
| 2011/0148329 | A1 | 6/2011 | Demarest |
| 2011/0279034 | A1 | 11/2011 | Lucas |
| 2012/0134157 | A1 | 5/2012 | Li |
| 2012/0155075 | A1 | 6/2012 | Asofsky |
| 2013/0050985 | A1 | 2/2013 | Kwok |

FOREIGN PATENT DOCUMENTS

| | | | |
|---|---|---|---|
| CN | 1578573 | A | 2/2005 |
| CN | 1650130 | A | 8/2005 |
| CN | 2747446 | Y | 12/2005 |
| CN | 2755047 | Y | 2/2006 |
| CN | 2769684 | Y | 4/2006 |
| CN | 2775459 | Y | 4/2006 |
| CN | 2781708 | Y | 5/2006 |
| CN | 2828532 | Y | 10/2006 |
| CN | 2859207 | Y | 1/2007 |
| CN | 2906310 | Y | 5/2007 |
| CN | 200979085 | Y | 11/2007 |
| CN | 200999983 | Y | 1/2008 |
| CN | 201000054 | Y | 1/2008 |
| CN | 201034248 | Y | 3/2008 |
| CN | 201034303 | Y | 3/2008 |
| CN | 201053583 | Y | 4/2008 |
| CN | 201066077 | Y | 5/2008 |
| CN | 201069056 | Y | 6/2008 |
| CN | 201137821 | Y | 10/2008 |
| CN | 101865413 | A | 10/2010 |
| DE | 1489617 | | 5/1969 |
| DE | 9307061 | U1 | 9/1993 |
| DE | 9414191 | U1 | 10/1994 |
| EP | 0138786 | A1 | 4/1985 |
| EP | 0600217 | A1 | 8/1994 |
| EP | 1199524 | A2 | 4/2002 |
| EP | 1199525 | A2 | 4/2002 |
| EP | 1199526 | A2 | 4/2002 |
| EP | 1199527 | A2 | 4/2002 |
| EP | 1223385 | A1 | 7/2002 |
| EP | 1328761 | A2 | 7/2003 |
| EP | 1137900 | B1 | 3/2004 |
| EP | 1939003 | A1 | 3/2004 |
| EP | 1427968 | A1 | 6/2004 |
| EP | 1439351 | A2 | 7/2004 |
| EP | 1199526 | B1 | 9/2004 |
| EP | 1199527 | B1 | 9/2004 |
| EP | 1488447 | A2 | 12/2004 |
| EP | 1496306 | A2 | 1/2005 |
| EP | 1223385 | B1 | 5/2005 |
| EP | 1313987 | B1 | 11/2005 |
| EP | 1439351 | A3 | 4/2006 |
| EP | 1655543 | A1 | 5/2006 |
| EP | 1659340 | A2 | 5/2006 |
| EP | 1659340 | A3 | 7/2006 |
| EP | 1703210 | A1 | 9/2006 |
| EP | 1703211 | A1 | 9/2006 |
| EP | 1427968 | B1 | 10/2006 |
| EP | 1797371 | A1 | 6/2007 |
| EP | 1800064 | A2 | 6/2007 |
| EP | 1832815 | A2 | 9/2007 |
| EP | 1838110 | A1 | 9/2007 |
| EP | 1869360 | A1 | 12/2007 |
| EP | 1878449 | A1 | 1/2008 |
| EP | 1936277 | A2 | 6/2008 |
| EP | 1938018 | A1 | 7/2008 |
| EP | 2587127 | A1 | 5/2013 |
| GB | 2323159 | A | 9/1998 |
| GB | 2350885 | A | 12/2000 |
| GB | 2379731 | A | 3/2003 |
| GB | 2438519 | A | 11/2007 |
| GB | 257485 | A | 8/2009 |
| JP | 06-052709 | | 2/1994 |
| JP | 2000-284730 | | 10/2000 |
| JP | 2008-180755 | | 8/2008 |
| WO | WO82/02756 | | 8/1982 |
| WO | WO87/04506 | | 7/1987 |
| WO | WO95/04243 | | 2/1995 |
| WO | WO96/25624 | | 8/1996 |
| WO | WO97/28671 | | 8/1997 |
| WO | WO97/41393 | | 11/1997 |
| WO | WO98/05014 | | 2/1998 |
| WO | WO01/04544 | A1 | 1/2001 |
| WO | WO01/57447 | A1 | 8/2001 |
| WO | WO02/018841 | A3 | 3/2002 |
| WO | WO02/035153 | A3 | 5/2002 |
| WO | WO02/099338 | A1 | 12/2002 |

(56) References Cited

FOREIGN PATENT DOCUMENTS

| | | | |
|---|---|---|---|
| WO | WO03/023286 | A1 | 3/2003 |
| WO | WO03/073466 | A2 | 9/2003 |
| WO | WO2004/063625 | A2 | 7/2004 |
| WO | WO2005/003623 | A2 | 1/2005 |
| WO | WO2005/038338 | A1 | 4/2005 |
| WO | WO2005/045321 | A1 | 5/2005 |
| WO | WO2006/020839 | A2 | 2/2006 |
| WO | WO2006/027273 | A1 | 3/2006 |
| WO | WO2006/040342 | A2 | 4/2006 |
| WO | WO2006/074544 | A1 | 7/2006 |
| WO | WO2006/104898 | A1 | 10/2006 |
| WO | WO2006/105703 | A1 | 10/2006 |
| WO | WO2007/039126 | A1 | 4/2007 |
| WO | WO2007/120540 | A1 | 10/2007 |
| WO | WO2007/141013 | A1 | 12/2007 |
| WO | WO2007/147887 | A2 | 12/2007 |
| WO | WO2008/060800 | A2 | 5/2008 |
| WO | WO2008/062061 | A2 | 5/2008 |
| WO | WO2008/073786 | A2 | 6/2008 |
| WO | WO2008/076326 | A2 | 6/2008 |
| WO | WO2012/000418 | A1 | 1/2012 |

OTHER PUBLICATIONS

European Patent Office, Communication pursuant to Article 94(3) EPC, in Application No. 12 870 606.6, dated February 11, 2016 (5 pages).

European Patent Office, Communication with Extended European search report, Application No. 15165256.7, dated Mar. 21, 2016 (5 pages).

PCT, Notification of Transmittal of the International Search Report and the Written Opinion of the International Searching Authority, in International application No. PCT/US13/29730, dated May 13, 2013.

PCT, Notification Concerning Transmittal of International Preliminary Report on Patentability, in International application No. PCT/US2012/061435, dated Sep. 18, 2014 (6 pages).

PCT, Notification Concerning Transmittal of International Preliminary Report on Patentability, in International application No. PCT/US2012/029730, dated Sep. 18, 2014 (7 pages).

LittleBrightLights.com, Flame Lights, Vaughan Safety, Inc. Company, Tuesday, Oct. 5, 2010; retrieved from the Internet on Jan. 26, 2011. (3 pages).

"Mini Hanging Fire Bowl" by Visual Effects; from Amazon.com, retrieved from teh Internet on Jan. 26, 2011. (3 pages).

"New Blue Faux Flame Safe Halloween Pumpkin LED Candle" by Unknown, from Amazon.com, retrieved from the Internet on Jan. 26, 2011. (3 pages).

Battery Operated Flame Light Olympic Torch, Olympic Flame Torch, Caufields, retrieved from the internet on Jan. 26, 2011. (2 pages).

"12v ac party lights," thefind, retrieved from the Internet on Jan. 26, 2011. (4 pages).

"Sensor LED 7 Color Change Flameless Candle light," Diwali, e-bay, retrieved from the Internet on Jan. 26, 2011. (4 pages).

"Home Stove Stage Silk Flame Effect Light Lamp Fire Fake," Shopzilla.co.uk, retrieved from the internet on Jan. 26, 2011. (6 pages).

"Silk Flame Machine Hire," IA Sound & Light, retrieved from the internet on Jan. 26, 2011. (6 pages).

"Silk Flame," Wicked Beernut Home, Halloween Home, retrieved from the Internet on Jan. 26, 2011. (7 pages).

"Silk Torches" retrieved from the internet on Jan. 26, 2011. (4 pages).

"Smart Candle," smart Candle, Asia Ltd., retrieved from the internet on Jan. 26, 2011. (2 pages).

"2010 Updated Speeder's Faux Flaming Caldron," Halloween Forum.com, retrieved from the internet on Jan. 26, 2011. (2 pages).

"Faux Flame With Housing," thefind, retrieved from the internet on Jan. 26, 2011. (2 pages).

"Flame Effect Light," Twenga, retrieved from the Internet on Jan. 26, 2011. (3 pages).

"Vei Faux Flame V-0104 Vulcan's Fire Hanging silk Flame Effect," Minions Web, retrieved from the internet on Jan. 26, 2011. (3 pages).

Faux Flame Hanging Light, Kijiji, Ottawa, Canada, http://ottawa.kijiji.ca/c-buy-and-sell-furniture-lamps-lighting-Faux-Flam . . . retrieved from the Internet on Jan. 26, 2011. (1 page).

"Silk flame ,fake, faux flame engines," http://www.amazingpartythemes.com/flame-fx/units/battery.htm., retrieved from the Internet on Jan. 26, 2011. (2 pages).

Shells: User's Guide, HP 9000 Computers, Hewlett Packard, HP Part No. B2355-90046, Printed in USA, Aug. 1992, Second Edition E0892. (432 pages).

U.S. Pat. No. 8,132,936—file history. Publication date Mar. 13, 2012. (397 pages).

European Patent Office, European Search Report, in Application No. EP12185984, Dec. 4, 2012. (2 pages).

PCT, International Search Report, in Application No. PCTUS2009/054401, dated Oct. 16, 2009. (4 pages).

European Patent Office, Supplemental European Search Report, in application No. EP12870606, dated Sep. 7, 2015 (6 pages).

* cited by examiner

ELECTRONIC LUMINARY DEVICE WITH SIMULATED FLAME

CROSS REFERENCE TO RELATED APPLICATIONS

This application is a continuation of U.S. patent application Ser. No. 13/789,624 filed on Mar. 7, 2013, and claims priority to U.S. patent application Ser. No. 61/607,942 filed on Mar. 7, 2012, the entireties of which are herein incorporated by reference.

FEDERALLY SPONSORED RESEARCH OR DEVELOPMENT

[Not Applicable]

JOINT RESEARCH AGREEMENT

[Not Applicable]

SEQUENCE LISTING

[Not Applicable]

BACKGROUND

Generally, this application relates to flameless candles. Specifically, this application discloses techniques for simulating a candle flame without use of moving parts.

Flameless candles may provide an illusion of a real (flamed) candle, but without the risk of fire damage. A real candle flame moves in physical space. In order to simulate such movement, some have used an element or part that moves in physical space. Moving elements or parts, however, may be undesirable for various reasons. For example, moving parts may tend to become damaged, such as during shipping, by mishandling, or by unintentional events, and may be subject to wear and tear on repeated use.

Furthermore, flameless candles with moving parts may require additional components or systems to cause the moving parts to move. Such components or systems may include fans or magnetic systems. These components or systems may add cost to a flameless candle device.

SUMMARY

According to techniques of this application, a device includes a side wall, a base, an upper surface, a riser, an opaque disk, a projection screen, a first source of light, a second source of light, and circuitry. The side wall may have a minimum height, an upper region, and a lower region. The base may engage with the lower region of the side wall. The upper surface may extend from the upper region of the side wall to form an upper recess. The riser may extend upwardly away from the base. The opaque disk may be located at a top of the riser. The opaque disk may include a first tunnel and a second tunnel, wherein each of the tunnels has a top end and a bottom end and is diagonally oriented in both a vertical and a horizontal dimension and further oriented such that the bottom ends of the tunnels are further apart than the top ends of the tunnels.

The projection screen may include a flame shape with a front side having convexity, relative to a source of light which projects upon it. The projection screen may extend upwardly from the opaque disk through an aperture in the upper surface and positioned off of a central axis of the aperture through the upper surface. The projection screen may include a fixed end and a free end. The fixed end of the projection screen may be fixedly attached to the opaque disk, whereby the projection screen is fixed with respect to a position of the upper surface. The free end of the projection screen may be located at a height below the maximum or minimum height of the sidewall.

The first source of light may be positioned below the upper surface and configured to project light through the aperture onto the projection screen. The first source of light may be located at a fixed distance from the projection screen that is at least partially within the second tunnel such that a top end of the second source of light is located at a height below the top end of the second tunnel.

The second source of light positioned below the upper surface and configured to project light through the aperture onto the projection screen. The second source of light may be located at a fixed distance from the projection screen that is at least partially within the first tunnel such that a top end of the first source of light is located at a height below the top end of the first tunnel. The tunnels may have interior surfaces that encourage specular reflection or diffusion depending on the desired optical effect.

The circuitry may be electrically connected to the first source of light and the second source of light. The circuitry may be configured to independently control intensities of the light projected by the first source of light and the second source of light.

The projection screen may include a primary plane. The first source of light may emit light including a beam axis and a beam width. The beam axis of the first source of light may intersect the primary plane of the projection screen at an angle between 20° to 40°. The second source of light may emit light including a beam axis and a beam width. The beam axis of the first source of light may intersect the primary plane of the projection screen at an angle between 20° to 40°.

The beam width of the light emitted by the first source of light may be between 30° to 35°. The beam width of the light may be emitted by the second source of light is between 30° to 35°. The projection screen may include a translucent material that allows light from the first source of light to penetrate to the back side of the projection screen and may allow light from the second source of light to penetrate to the front side of the projection screen. The projection screen may have a static shape. The projection screen may be rigid. The projection screen may include plastic.

The first area may be offset from the second area along a vertical dimension. The first area may be offset from the second area along a horizontal dimension. The first source of light may be positioned to project light onto a front side of the projection screen in a first area, the second source of light may be positioned to project light through the aperture onto the front side of the projection screen in a second area, wherein the second area may be overlapping but different than the first area.

According to techniques of the application, a device may include a side wall, a base, and an upper surface. The side wall may have an upper region and a lower region. The base may be engaged with the lower region of the side wall. The upper surface may extend from the upper region of the side wall to form an upper recess.

The device may include a projection screen extending upwardly through an aperture in the upper surface. The position of the projection screen may be fixed with respect to the position of the upper surface. The projection screen may be flat or may have a concavity or convexity. The projection screen may have a general two-dimensional or three-dimensional appearance. The projection screen may be shaped like a flame. The projection screen may have a primary plane, but, alternatively may be ovoid. The projection screen may be translucent. The projection screen may be formed from a material such as plastic, glass, or metal.

A first source of light may be positioned below the upper surface and may to project light through the aperture onto the projection screen. A second source of light may be positioned below the upper surface and may to project light through the aperture onto the projection screen. The positions of the first source of light and the second source of light may also be fixed with respect to the position of the projection screen.

The light from the first and second sources of light may be projected onto the front side of the projection screen or onto the front and back side of the projection screen. Light projected onto one side of the projection screen may penetrate through to the other side of the projection screen. Each of the sources of light may emit light with a beam axis and a beam width. One or more of the beam axes may intersect with the primary plane of the projection screen at an angle between 20° to 40°. One or more of the beam widths may be between 30° to 35°.

The sources of light may be positioned to project light onto different areas of the projection screen. These areas may be distinct or may overlap.

Circuitry may electrically connect to the first source of light and the second source of light. The circuitry may independently control intensities of the light projected by the first source of light and the second source of light.

Figure 1:
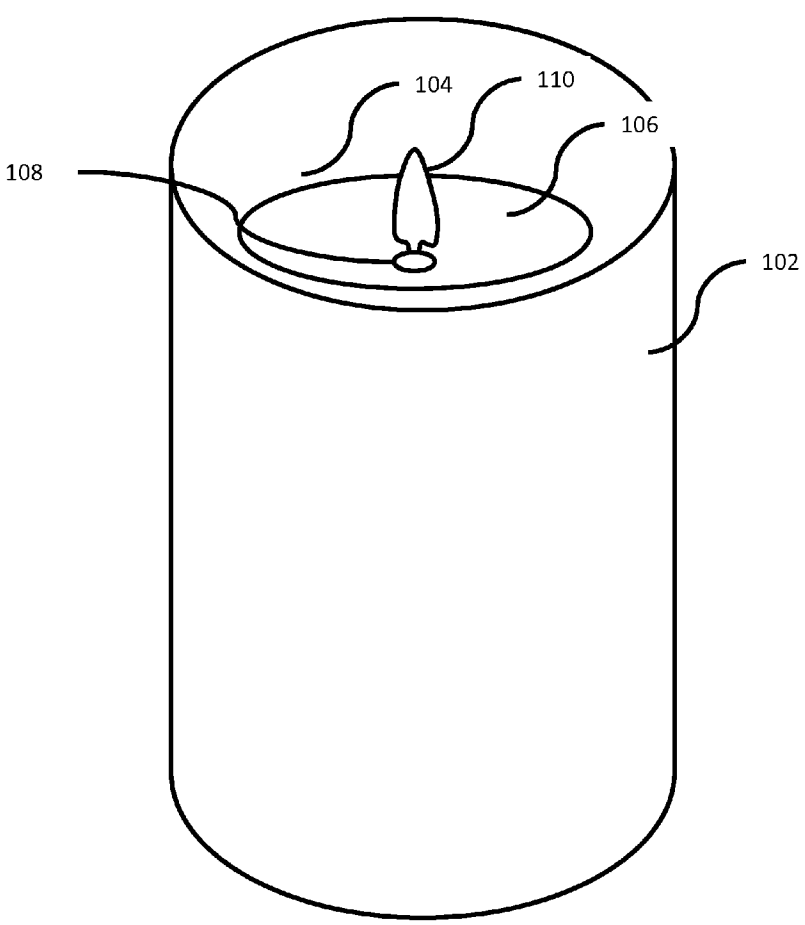
FIG. 1 illustrates an electronic candle, according to techniques of the present application.

The foregoing summary, as well as the following detailed description of certain techniques of the present application, will be better understood when read in conjunction with the appended drawings. For the purposes of illustration, certain techniques are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION

FIGS. 1-3B illustrate an electronic candle 100, according to techniques of the present application. As shown in FIG. 1, the electronic candle 100 may include a side wall 102 having an upper region and a lower region. A base 150 (see FIG. 2) may be engaged with the lower region of the side wall 102. An upper surface 106 may extend from the upper region of the sidewall 102 to form an upper recess 104. The upper recess 104 may have a variety of different shapes. The upper recess 104 may be shaped like a bowl or a portion of a bowl. For example, the upper region of the side wall 102 may have a varying height around the top perimeter of the electronic candle 100. The upper recess 104 may have a rounded or flat bottom surface. The upper recess 104 may have a smooth or textured bottom surface. The upper recess 104 may have a cylindrical shape.

A projection screen 110 may be adjacent to and/or extend upwardly through an aperture 108 in the upper surface 106. The projection screen 110 may be offset with respect to or positioned off of a central axis of the aperture 108. The position of the projection screen 110 may be fixed with respect to the upper surface 106. Of course, an undue amount of force could cause the projection screen 110 to deflect or otherwise change position with respect to the upper surface 106. However, an anticipated movement of the electronic candle 100 (for example, picking up or putting down the candle, rotating the candle, or turning the candle upside down) may not influence the position of the projection screen with respect to the upper surface 106.

Figure 2:
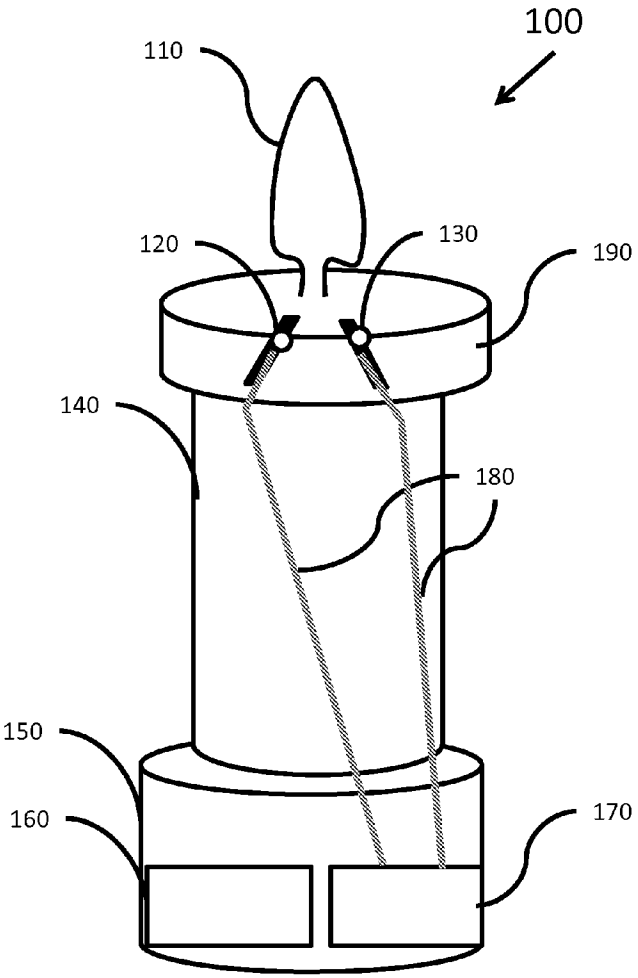
FIG. 2 illustrates a portion of an electronic candle, according to techniques of the present application.

As shown in FIG. 2, the electronic candle 100 may include a base 150. The base 150 may accommodate batteries in a battery compartment 160. The base 150 may also accommodate circuitry 170. The battery compartment 160 and circuitry 170 need not be located in or around the base 150, and could be located at other areas of the electronic candle 100. For example, the circuitry 170 may be embedded in one or more of sources of light 120, 130. The circuitry 170 and sources of light 120, 130 may receive power from one or more batteries in the battery compartment 160.

A riser 140 may extend upwardly away from the base 150. An opaque disk 190 may be located at a top of the riser 140. As shown in FIG. 2, the opaque may include two tunnels. The tunnels may each be diagonally oriented in a vertical dimension and/or a horizontal dimension. The tunnels may traverse the height of the opaque disk 190, creating an open path in the interior of the opaque disk, from the top to the bottom. The opaque disk 190 may substantially attenuate the intensity of light that is emitted through the portion of the sidewall 102 located below the opaque disk 190.

The sources of light 120 and 130 may be located near or at the top of the riser 140 or opaque disk 190. The sources of light 120, 130 may include a light-emitting diode ("LED") an incandescent bulb, or a laser. In certain configurations, a riser 149 or opaque disk 190 may not be necessary. For example, the sources of light 120, 130 may be embedded in other parts of the candle 100.

Each of the sources of light 120, 130 may be located at least partially within a respective tunnel. A given source of light may be located such that the top end of the source of light is located at a height below a top end of the given tunnel. In such a configuration, a tunnel may be employed to collimate a beam of light emitted by a source of light, thereby reducing the beam width of the beam of light.

The projection screen 110 may include a fixed end and a free end. The free end of the projection screen 110 may extend upwardly from the riser 140 or opaque disk 190. The fixed end of the projection screen 110 may be rigidly affixed to the riser 140 or opaque disk 190 at or near the top of the riser 140 or opaque disk 190. For example, the projection screen 110 may be integral with the riser 140 or opaque disk 190. The projection screen 110 may be a separate portion rigidly or fixedly attached to the riser 140 or opaque disk 190 (for example, glued or attached at more than one place). For example, the fixed end of the projection screen 110 may be part of a tab that is inserted into one slot (or one of a plurality of slots) in the riser 140 or opaque disk 190.

By rigidly or fixedly affixing the projection screen 110 with the riser 140 or opaque disk 190, it may be possible to fix the position of the projection screen 110 with respect to the upper surface 106. There may be other ways to fix the positions of the projection screen 110 and the upper surface 106. For example, the projection screen 110 may be affixed to the upper surface 106 or to the sidewall 102 instead of the riser 140.

The free end of the projection screen 110 may be located at a height above the base 150 of the candle. This height may be less than a minimum or maximum height of the sidewall 102. This may prevent the projection screen 110 from becoming damaged if the candle 100, for example, is turned upside down.

The projection screen 110 may be rigid. The projection screen 110 may be formed from one or more materials, such as glass, plastic, metal, or foil. Such material(s) may be at least partially reflective. The projection screen 110 may be opaque, semi-opaque, clear, frosted, or translucent. The projection screen 110 may have a mesh or other textured surface. The projection screen 110 may facilitate display of holographic images.

The surface of the projection screen 110 may be flat, concave, or convex. The surface of the projection screen 110 may be various combinations of flat, concave, and/or convex. The projection screen 110 may have a two-dimensional or three-dimensional appearance. The projection screen 110 may have a flame shape. Such a shape may be static, in that it does not change. The projection screen 110 may have one or more projection surfaces. For example, the projection screen 110 may have two projection surfaces—front and back. The projection screen 110 may have additional projection surfaces. For example, the projection screen 110 may have three or more surfaces, each receiving light from one or more sources of light. The projection screen 110 may have surfaces that wrap around to form a shape with substantial depth. For example, the projection screen 110 may have a three-dimensional shape resembling an actual candle flame and may be substantially convex around the perimeter of the three-dimensional projection screen (for example, bulbously shaped). In such an example, sources of light may be located around the projection screen 110 and may project onto the projection screen 110. In one example, when light is projected upwardly towards a convex projection screen 110, the illusion of a "hot spot" in a flame may be created.

The projection screen 110 may be of uniform color or may have different colors. For example, the projection screen 110 may be painted or patterned to show a simulated wick. As one way to provide an illusion of a real candle flame, the projection screen 110 may have darker colors near an area where a wick would be expected. The projection screen 110 may have different colors (for example, blue, white, orange, or yellow) to simulate different flame temperatures and intensities as a viewer may expect in a real candle flame. The colors may be chosen in combination with light colors emitted from the sources of light 120, 130.

The sources of light 120, 130 may be electrically connected to circuitry 170 through one or more conductors 180. The circuitry 170 may include a processor and one or more computer-readable storage devices that store software instructions for execution by the processor. The circuitry 170 may independently control one or more different aspects of the light projected by the sources of light 120, 130. For example, the circuitry 170 may be capable of separately controlling the intensity or color for each source of light 120, 130. The intensities of each source of light 120, 130 may be adjusted by varying a pulse-code modulated signal or a pulse-width modulated signal provided to the given source of light 120, 130.

The circuitry 170 may illuminate each source of light 120, 130 with different sequences of intensities. Such sequences may include random sequences, semi-random sequences, or predetermined sequences. A sequence may include a repeating loop (for example, a 5-10 second loop). Such sequences may include frequencies that are out of phase from each other. For example, one predetermined sequence may be applied to the source of light 120, and the same predetermined sequence may be applied to the source of light 130, but out of phase. As another example, a first predetermined sequence may be applied to the source of light 120 and second predetermined sequence may be synchronously applied to the source of light 130. The second predetermined sequence may result from filtering or adjusting the first predetermined sequence. Such filtering may include high-pass and low-pass filtering, and such adjusting may include attenuating the amplitudes of the first predetermined sequence.

Sequences may be dynamically influenced by other factors or inputs. For example, an output signal from a light sensor (not shown) could be received by the circuitry 170, which may, in turn, adjust the intensity levels in sequences according to the light sensor output signal (for example, boost the intensities under higher light). As another example, an output signal from a sound sensor (not shown) could be received by the circuitry 170, which may, in turn, adjust the intensity levels in sequences according to the sound sensor output signal (for example, adjust the frequency of the intensity changes in response to the character of received sound).

According to one example, it may be possible to provide a separate controller for each source of light 120, 130. Each separate controller may be integrated into an epoxy case that houses a light-emitting diode. The two separate controllers may be synchronized through a synchronization signal provided to each controller or between the controllers. For example, an additional lead may extend from the controller and to outside of the epoxy case. The additional leads from two LED assemblies may be connected together and a synchronization signal may be communicated between via this connection to enable synchronous operation.

Figure 3A:
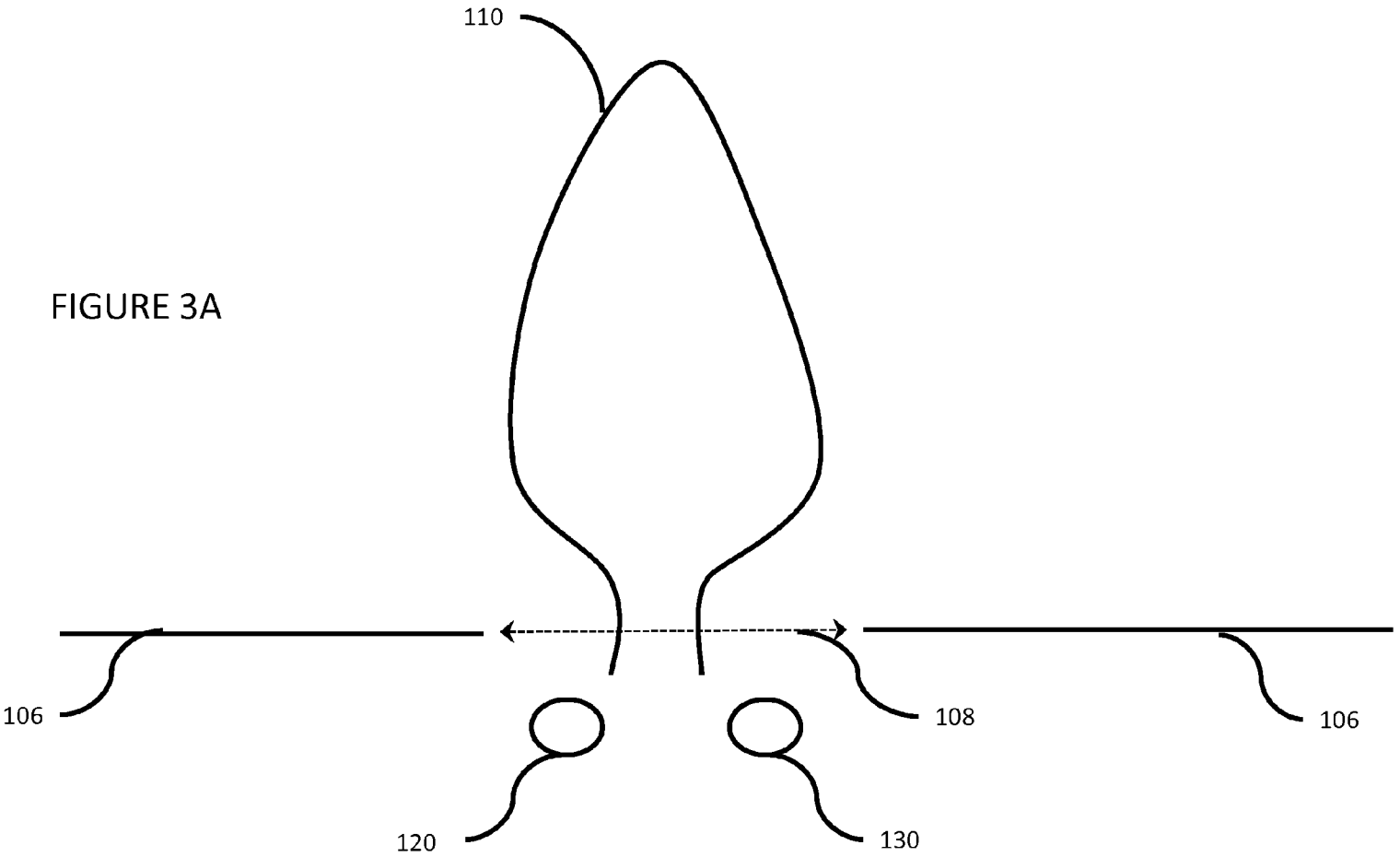
FIGS. 3A and 3B illustrate a projection screen and sources of light, according to techniques of the present application.

As illustrated in FIG. 3A, the projection screen 110 extends upwardly through the aperture 108 in the upper surface 106. While not shown in this example, the position of the projection screen 110 is fixed with respect to the upper surface 106. The sources of light 120, 130 may be positioned below the upper surface 106. They may be positioned and configured in such a manner to project light onto the projection screen 110, which may be through the aperture 108. The positions of the sources of light 120, 130 may also be fixed with respect to the position of the projection screen 110.

The projection screen 110 may have a primary plane. Such a plane may be substantially vertical and may generally face the direction of emitted light from the sources of light 120, 130. Even if the projection screen 110 is not entirely flat, it should be understood that the projection screen 110 still may have a primary plane.

Figure 3B:
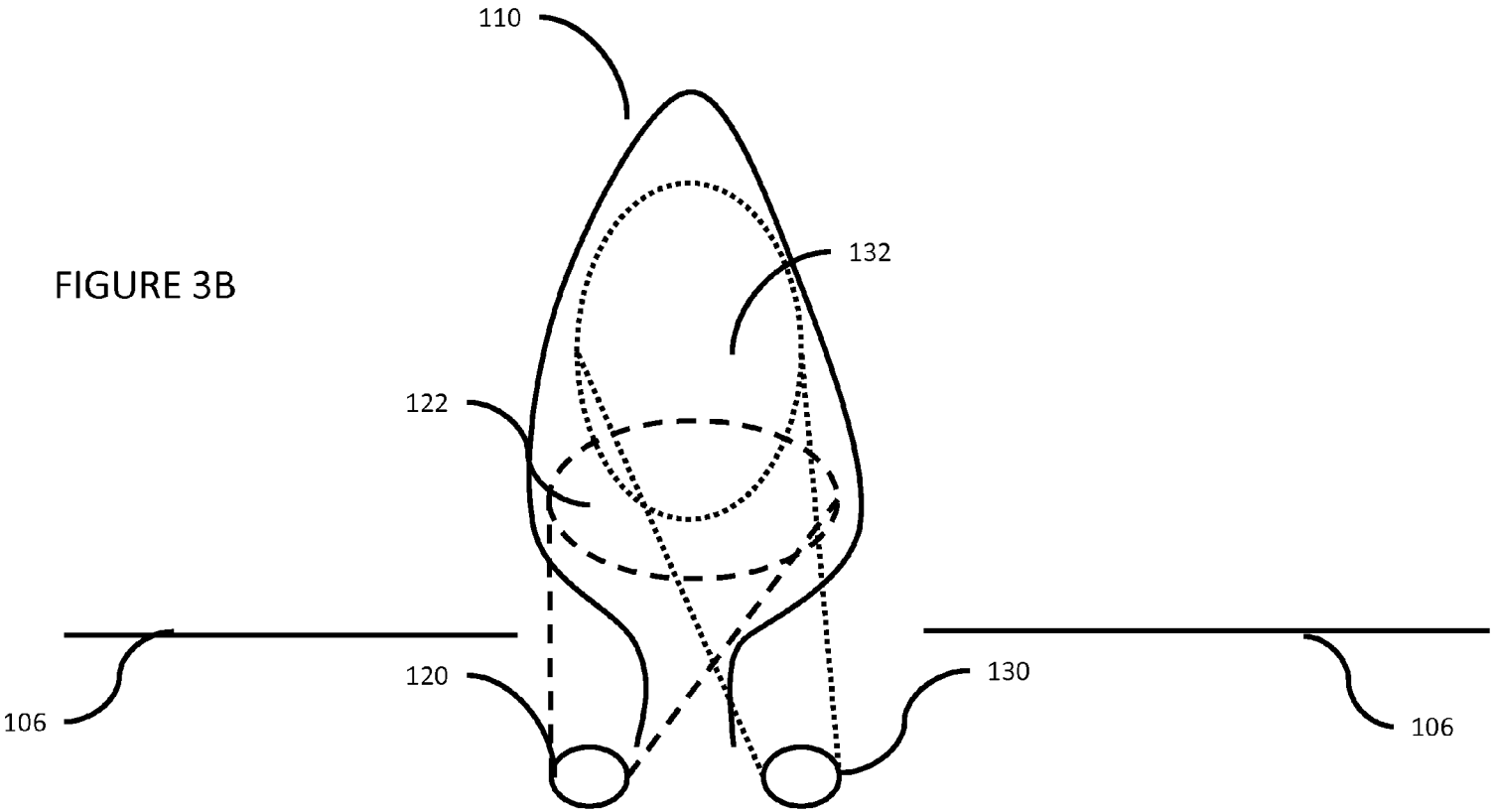

Referring to FIG. 3B, each source of light 120, 130 may project light (either completely or partially) through the aperture 108 in the upper surface 106 and onto the projection screen 110. The light emitted from each source of light 120, 130 may radiate according to a beam width. For example, the beam widths for the light emitted from the sources of light 120, 130 may be between 30-35 degrees. In the case of certain types of LEDs, such as amber LEDs, the beam widths may be between 10-20 degrees. The beam axis for the light emitted from each of the sources of light may intersect with the primary plane of the projection screen 110. Such an intersection may have an angle between 20-40 degrees. The sources of light 120, 130 may project light onto the same side or different sides of the projection screen 110. For example, the source of light 120 may project light onto the front side of the projection screen 110, while the source of light 130 may project light onto the back side of the projection screen 110. If the projection screen 110 is translucent, light projected onto one side may penetrate to the other side.

The source of light 120 may project light onto an area 122 on the projection screen 110. The source of light 130 may project light onto an area 132 on the projection screen 110. The areas 122, 132 may be coextensive, overlapping, or separate from each other. The areas 122 may have different or similar shapes. The shapes may be influenced by the beam width of projected light, angle of incidence of the beam axis with the primary plane of the projection screen 110, the distance of a source of light 120, 130 from the projection screen 110, the contour of the light-receiving surface of the projection screen 110, or by other factors. For example, it may be possible to provide lenses, apertures, or the like to form a beam of light having a particular shape. Such shape(s) may influence the shape of area(s) 122, 132.

According to one example, area 122 is offset from area 132. The approximate center of area 122 may be offset from the approximate center of area 132 by about 1-2 mm along a horizontal axis and by about 3-4 mm along a vertical axis.

At least some of the light emitted from the sources of light 120, 130 may be reflected off of the projection screen 110 and towards a viewer's eye. For example, the light may be reflected directly off of the projection screen 110 and to the viewer's eye without passing through any intervening materials. The light may also be reflected at or within the upper surface 106. The light may also pass through the sidewall before reaching the viewer's eye.

As discussed above, the intensities or colors of each of the sources of light 120, 130 may be independently controlled by circuitry 170. Through such independent control, it may be possible to simulate a candle flame. For example, it may be possible to simulate the physical movement and varying intensity profiles of a candle flame without employing moving parts.

More than two sources of light may be used. For example, three sources of light may be projected onto one side of the projection screen 110. Each of these sources of light may be independently controlled, such as by the techniques discussed above. As another example, four sources of light may be used. Two of the sources may project light onto one side of the projection screen 110 and the other two sources may project light onto another side of the projection screen 110.

It will be understood by those skilled in the art that various changes may be made and equivalents may be substituted without departing from the scope of the novel techniques disclosed in this application. In addition, many modifications may be made to adapt a particular situation or material to the teachings of the novel techniques without departing from its scope. For example, while an electronic candle has been primarily disclosed, similar techniques could be applied to other luminary devices, such as wall sconces, lanterns, paper candles, or tiki torches. Therefore, it is intended that the novel techniques not be limited to the particular techniques disclosed, but that they will include all techniques falling within the scope of the appended claims.

The invention claimed is:

1. A device for simulating a flame, comprising:

a side wall including an upper region and a lower region;

a base engaged with the lower region of the side wall;

an upper surface extending from the upper region of the side wall toward a central axis of the device, wherein an upper recess is formed at least in part by the upper surface;

a riser extending away from the base toward the upper surface;

a platform above the base and supported by the riser;

a projection screen that:

is fixedly attached to at least one of the platform, the riser, or the upper surface such that the projection screen does not move with respect to the upper surface; and extends above the upper surface;

a first source of light located below the upper surface, wherein the first source of light is configured to project light through an aperture in the upper surface onto the projection screen;

a second source of light located below the upper surface, wherein the second source of light is configured to project light through the aperture in the upper surface onto the projection screen; and circuitry electrically connected to the first source of light and the second source of light, wherein the circuitry is configured to independently control an intensity of the light projected by the first source of light and an intensity of the light projected by the second source of light.

2. The device of claim 1, wherein the projection screen comprises a flame-shape.

3. The device of claim 1, wherein the projection screen is offset from a central axis of the aperture through the upper surface.

4. The device of claim 1, wherein the projection screen does not extend below the platform.

5. The device of claim 1, wherein the first source of light is positioned to project light onto a front side of the projection screen thereby defining a first area, the second source of light is positioned to project light through the aperture onto the front side of the projection screen thereby defining a second area, wherein the second area is overlapping but different than the first area.

6. The device of claim 1, wherein the projection screen is rigid.

7. The device of claim 1, wherein the projection screen is fixedly attached to the upper surface.

8. The device of claim 1, wherein the upper recess is formed at least in part by the upper surface and a portion of the side wall.

9. A device for simulating a flame, comprising:

a side wall including an upper region and a lower region;

a base engaged with the lower region of the side wall;

an upper surface extending from the upper region of the side wall toward a central axis of the device, wherein an upper recess is formed at least in part from the upper surface;

a riser extending away from the base towards the upper surface;

a platform above the base and supported by the riser;

a projection screen that:

is fixedly attached to the platform such that the projection screen does not move with respect to the upper surface; and extends upwardly from an aperture in the upper surface;

a first source of light located on at least one of the platform or the riser, wherein the first source of light is configured to project light through the aperture onto the projection screen;

a second source of light located on at least one of the platform or the riser, wherein the second source of light is configured to project light through the aperture onto the projection screen; and circuitry electrically connected to the first source of light and the second source of light, wherein the circuitry is configured to independently control an intensity of the light projected by the first source of light and an intensity of the light projected by the second source of light.

10. The device of claim 9, wherein the projection screen comprises a flame-shape.

11. The device of claim 9, wherein the projection screen is offset from a central axis of the aperture through the upper surface.

12. The device of claim 9, wherein the projection screen does not extend below the platform.

13. The device of claim 9, wherein the first source of light is positioned to project light onto a front side of the projection screen thereby defining a first area, the second source of light is positioned to project light through the aperture onto the front side of the projection screen thereby defining a second area, wherein the second area is overlapping but different than the first area.

14. The device of claim 9, wherein the projection screen is rigid.

15. The device of claim 9, wherein the upper recess is formed at least in part by the upper surface and a portion of the side wall.

16. A device for simulating a flame, comprising:

a side wall including an upper region and a lower region;

an upper surface extending from the upper region of the side wall toward a central axis of the device, wherein an upper recess is formed at least in part by the upper surface;

a projection screen arranged to extend upwardly from an aperture in the upper surface;

a first source of light located below the upper surface and configured to project a first beam of light through the aperture onto the projection screen;

a first lens configured to alter the first beam of light; and circuitry configured to control an intensity of the first source of light.

17. The device of claim 16, further comprising:

a second source of light located below the upper surface and configured to project a second beam of light through the aperture onto the projection screen;

a second lens configured to alter the second beam of light; and wherein the circuitry is further configured to independently control the intensity of the first beam of light and the intensity of the second beam of light.

18. The device of claim 17, wherein the first source of light is positioned to project light onto a front side of the projection screen thereby defining a first area, the second source of light is positioned to project light through the aperture onto the front side of the projection screen thereby defining a second area, wherein the second area is overlapping but different than the first area.

19. The device of claim 16, wherein the projection screen comprises a flame-shape.

20. The device of claim 16, wherein the projection screen is offset from a central axis of the aperture through the upper surface.

21. The device of claim 16, wherein the projection screen is rigid.

22. The device of claim 16, wherein the upper recess is formed at least in part by the upper surface and a portion of the side wall.

* * * * *